United States Patent [19]

Tischer et al.

[11] Patent Number: 4,573,324

[45] Date of Patent: Mar. 4, 1986

[54] COMPRESSOR MOTOR HOUSING AS AN ECONOMIZER AND MOTOR COOLER IN A REFRIGERATION SYSTEM

[75] Inventors: James C. Tischer, La Crescent, Minn.; James W. Larson, La Crosse, Wis.

[73] Assignee: American Standard Inc., New York, N.Y.

[21] Appl. No.: 708,301

[22] Filed: Mar. 4, 1985

[51] Int. Cl.[4] ..... F25B 1/00

[52] U.S. Cl. ..... 62/115; 62/505; 310/64; 418/97

[58] Field of Search ..... 62/84, 115, 468, 469, 62/505; 310/64; 418/97

[56] References Cited

U.S. PATENT DOCUMENTS

| | | | |
|---|---|---|---|
| 2,921,446 | 1/1960 | Zulinke | 62/117 |
| 3,388,559 | 6/1968 | Johnson | 62/224 |
| 3,710,590 | 1/1973 | Kocher | 62/468 |
| 3,795,117 | 3/1974 | Moody, Jr. et al. | 62/505 |
| 3,805,547 | 4/1974 | Eber | 62/505 |
| 3,859,815 | 1/1975 | Kashara | 62/505 |
| 3,913,346 | 10/1975 | Moody, Jr. | 62/197 |
| 3,945,219 | 3/1976 | Kasahara | 62/469 |
| 4,062,199 | 12/1977 | Kasahara et al. | 62/505 |
| 4,497,185 | 2/1985 | Shaw | 62/468 |

*Primary Examiner*—Ronald C. Capossela
*Attorney, Agent, or Firm*—Ronald M. Anderson; William J. Beres; Carl M. Lewis

[57] ABSTRACT

Liquid refrigerant produced in the condenser of a refrigeration system is directed into an expansion device. The expansion device throttles the high pressure liquid refrigerant into the compressor drive motor housing of the compressor assembly within the refrigeration system. Upon entering the motor housing a first portion of the liquid refrigerant flashes into gas at a pressure intermediate compressor suction and discharge pressure. The portion of refrigerant which remains in the liquid state is directed into a jacket surrounding the stator of the compressor drive motor. As the jacket fills with liquid refrigerant, a portion of the refrigerant is directed through passages in the motor stator into contact with the motor rotor. Liquid refrigerant overflowing the jacket and flowing out the ends of the motor through the gap between the rotor and stator drains to the lowermost portion of the motor housing from where it is directed to a second expansion device. Flash gas within the drive motor housing, together with gas generated by motor cooling, is directed out of the motor housing and into the compression chamber of the compressor assembly in order to increase the capacity and efficiency of the refrigeration system.

19 Claims, 3 Drawing Figures

COMPRESSOR MOTOR HOUSING AS AN ECONOMIZER AND MOTOR COOLER IN A REFRIGERATION SYSTEM

BACKGROUND OF THE INVENTION

1. Field of the Invention

The present invention relates to the art of compressing a refrigerant gas in an electric motor driven compressor. More particularly, the present invention relates both to providing refrigerant gas at a pressure intermediate the compressor suction and discharge pressures to the working chamber of a compressor in a refrigeration system while simultaneously cooling the compressor drive motor all in a single housing. With even more particularity, the present invention relates to cooling the drive motor of a screw compressor in a refrigeration system with liquid refrigerant, while simultaneously directing refrigerant which has flashed into gas within the drive motor housing, together with gas generated by drive motor cooling, into the compression chamber of the compressor assembly within the system.

2. Description of Prior Art

The substantial advantages relating to increasing the efficiency and capacity of a refrigeration system by economizer coupling are well documented. Refrigeration systems in which screw compressors are employed are particularly amenable to economizer coupling by virtue of the geometry of the rotors and compression chamber found therein. Two complementary rotors are located in the compression or working chamber of a screw compressor. The motor which drives the rotors is normally located in a second housing attached to but sealed from the housing which defines the compression chamber. Refrigerant gas is received at low pressure and enters the suction port of a screw compressor where it is enveloped in a pocket formed between the compressor rotors. The volume of this pocket decreases and the pressure therein rises as the rotors rotate and mesh. The pocket is circumferentially displaced and eventually opens to the discharge port at the high pressure end of the compressor.

When an economizer vessel is employed and disposed in a refrigeration circuit, refrigerant gas generated within the economizer vessel is delivered to the working chamber of the compressor at a location where the pressure within the working chamber is intermediate the suction and discharge pressure of the compressor. The delivery of such gas, called economizer coupling, is advantageous in that the refrigeration capacity of the system is increased to an extent which more than offsets the increased power consumption needed to compress the additional amount of gas delivered to the compression chamber. The use of refrigerant gas produced in an economizer vessel disposed in a refrigeration system to cool the motor of the refrigerant compressor therein is known. U.S. Pat. No. 3,913,346 to Moody, Jr. et al discloses the use of refrigerant to cool the drive motor of a screw compressor and recites a concise litany of pertinent previously patented compressor motor cooling schemes. In the Moody, Jr. et al patent a portion of the liquid refrigerant produced in a condenser and flash gas produced in an economizer vessel are separately directed into a compressor motor housing. Liquid refrigerant delivered from the compressor drive motor housing is fed into the compression chamber to cool the compressor rotors. Vanes attached to the motor rotor splash liquid refrigerant, which is accumulated in the lower portion of the motor housing, over the motor stator to accomplish motor cooling. In U.S. Pat. No. 2,921,446 flash gas is directed from an economizer vessel into the sealed motor housing of a centrifugal refrigerant compressor. After passing through the compressor motor and motor housing the refrigerant gas, which has expanded in the course of motor cooling, is directed into the working chamber of the compressor. U.S. Pat. No. 3,388,559 discloses an installation in which a portion of the refrigerant exiting the condenser in a refrigeration circuit is metered into the housing of a compressor motor by an expansion valve dedicated to the motor cooling task. The refrigerant expands in the motor housing while cooling the compressor motor and is thereafter returned to the suction gas line in the refrigeration circuit. Likewise, U.S. Pat. No. 3,945,219 describes an installation in which a portion of the refrigerant exiting the condenser of a refrigeration circuit is metered into the compressor drive motor housing by a throttling device dedicated to the accomplishment of compressor motor cooling. The refrigerant metered into the compressor motor housing expands as it cools the compressor motor, mixes with compressor motor lubricant and together with the lubricant is directed into the working chamber of the screw compressor driven by the motor.

As is suggested by the wealth and diversity of compressor motor cooling schemes found in the prior art, a continuing need exists both for continued improvements in the implementation of economizer coupling and for a more economical and efficient method and apparatus by which the cooling of the motor driving a refrigeration compressor is accomplished.

SUMMARY OF THE INVENTION

The present invention has, as a primary object, the efficient cooling of the electric drive motor of a compressor, such as a screw compressor, in a refrigeration system, while simultaneously delivering refrigerant gas at a pressure intermediate compressor suction and discharge pressure to the working chamber within the compressor housing. An additional object of this invention is to dispose of the separate economizer vessel oftentimes found in refrigeration systems, and hence the bulk, weight and costs associated therewith, while retaining the benefits of economizer coupling within the refrigeration system. The objects of the invention are accomplished in a compressor motor housing into which the liquid refrigerant output of the condenser within a refrigeration system is directly throttled.

Liquid refrigerant flows from the condenser in the refrigeration system of the present invention and is metered through a first expansion device into the compressor drive motor housing which is at a pressure lower than the pressure of the liquid refrigerant as the liquid refrigerant enters the expansion device. A first portion of the refrigerant metered into the drive motor housing flashes into refrigerant gas upon entry into the housing while a second portion of the refrigerant remains in the liquid state. The liquid portion of this two-phase refrigerant mixture is directed by force of gravity into a jacket surrounding the stator of the compressor drive motor. Liquid refrigerant accumulates in the stator jacket and flows through passages penetrating the stator into contact with the motor rotor thereby bathing the motor rotor and stator in liquid refrigerant. Excess liquid refrigerant overflowing the stator jacket and liquid refrigerant flowing out of the gap between the motor rotor and the motor stator at the ends of the motor settles into the lower portion of the motor housing. This liquid refrigerant is next directed out of the motor housing through a second expansion device to the evaporator within the refrigeration system. Refrigerant flash gas together with refrigerant gas generated by motor cooling is directed out of the compressor drive motor housing into the compression chamber of the compressor assembly. The drive motor housing therefore functions as an economizer within the refrigeration system while simultaneously providing for the cooling of the electric drive motor located therein.

The present invention will be more fully appreciated when the following detailed description of the preferred embodiment is considered with reference to the drawing figures.

DESCRIPTION OF THE PREFERRED EMBODIMENT

Figure 1:
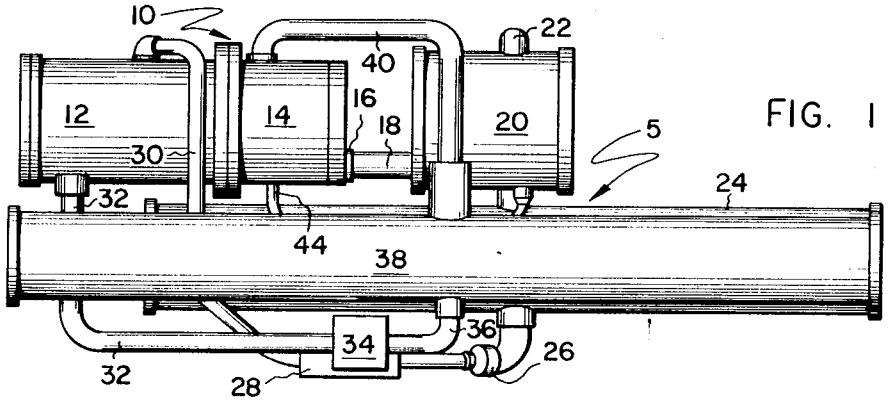
FIG. 1 is a perspective view of a refrigeration system according to the present invention.

Referring now to FIG. 1, it will be seen that closed refrigeration system 5 includes compressor assembly 10 which is divisible into two sections, motor housing section 12 and compressor section 14. As will be more fully explained hereinafter, the interior of motor housing section 12 is in flow communication with the compression chamber located in compressor section 14. Generally, a mixture of refrigerant gas and oil at high pressure is discharged from compressor section 14 through discharge port 16 and into conduit section 18. The mixture next enters oil separation apparatus 20 wherein oil is removed from the mixture. The refrigerant gas is directed out of oil separation apparatus 20 through conduit section 22 and into condenser 24. Refrigerant gas at high pressure and temperature entering condenser 24 condenses as it gives up heat to a medium which flows through the condenser in a heat exchange relationship with the refrigerant gas. Liquid refrigerant at high pressure produced in condenser 24 is directed through conduit section 26 into expansion device 28. Expansion device 28 throttles the liquid refrigerant a first time, bleeding the refrigerant through conduit section 30 into the interior of motor housing section 12. It will be understood that alternatively expansion device 28 may be disposed immediately adjacent or within motor housing section 12. A portion of the liquid refrigerant, now at a pressure lower than the pressure at which the refrigerant entered the expansion device, flashes into a gas in the upper portion of the motor housing. The flash gas results from of the expansion undergone by the liquid refrigerant as it is bled into the interior volume of the motor housing section. Flash gas thus generated is generated at a pressure intermediate condenser saturation pressure and evaporator saturation pressure, and, it follows, intermediate compressor suction pressure and compressor discharge pressure. The intermediate pressure at which flash gas is formed is a function of both of the operating parameters of the refrigeration system and the location of the port opening into the compression chamber through which the interior of motor housing section 12 communicates with the compression chamber in compressor section 14 of compressor assembly 10. The use of such gas for economizer coupling will subsequently be taken up.

Still referring only to FIG. 1, the portion of liquid refrigerant bled into motor housing section 12 through expansion device 28 which does not flash into a gas ultimately exits motor housing section 12 by way of conduit section 32 after performing a motor cooling function. This liquid refrigerant is directed to and through a second expansion device 34 where it is throttled a second time. The twice-throttled liquid refrigerant next enters conduit section 36 from where it is directed into evaporator 38 having been cooled in the expansion process. The relatively low pressure, low temperature liquid refrigerant entering evaporator 38 is vaporized as it extracts heat from a medium requiring cooling and which flows through the evaporator in a heat exchange relationship with the liquid refrigerant. Low pressure refrigerant gas exiting evaporator 38 is directed through conduit section 40 and into suction port 42 of compressor section 14. The refrigerant gas undergoes compression within compressor section 14 prior to being discharged through compressor discharge port 16. The terms "low", "intermediate" and "high" pressure are, of course, relative and depend upon the particular operating parameters of a refrigeration system. As previously stated though, the pressure of the refrigerant gas as it is discharged from compressor section 14 will be higher than the pressure of the refrigerant gas generated and found in the interior of motor housing section 12 which will in turn be at a higher pressure than a refrigerant gas entering suction port 38 of compressor section 14. It is to be noted that oil separated from the mixture discharged from compressor section 14 in oil separation apparatus 20 is directed back to compressor suction 14 for reinjection thereinto through oil conduit 44.

Figure 3:
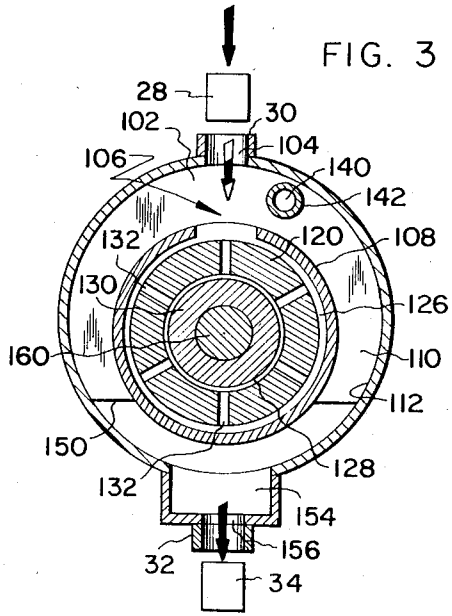
FIG. 3 is a sectional view of the motor section of the compressor assembly taken along section line 3—3 of FIG. 2.
Figure 2:
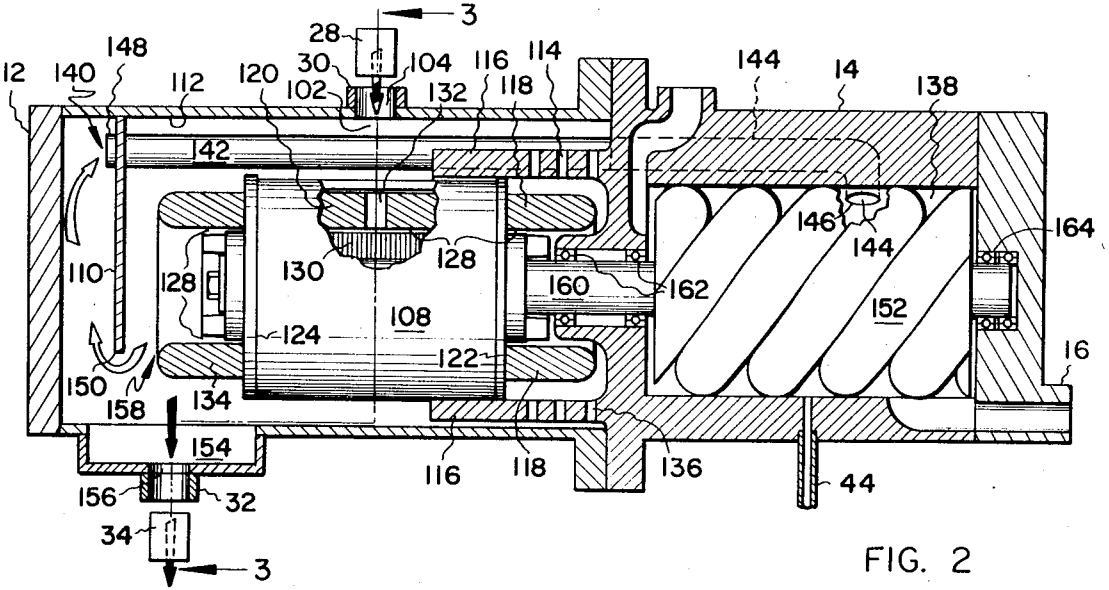
FIG. 2 is a cross-sectional view of the compressor assembly of the present invention including a breakaway view of a portion of the compressor drive motor and a breakaway view illustrating the location of the economizer port in the compression chamber of the compressor assembly.

By examining FIGS. 2 and 3, with the general perspective view of FIG. 1 and its workings in mind, a better appreciation for the present invention may be had. The liquid refrigerant produced by condenser 24 is at relatively high pressure and temperature as it enters expansion device 28. As the high pressure, high temperature liquid refrigerant is metered through expansion device 28 and into upper region 102 of the interior of motor housing section 12 through upper opening 104, a portion of the refrigerant rapidly and violently expands, flashing almost instantaneously into a gas at a pressure less than condenser saturation pressure. As a result, while the refrigeration system is in operation a two-phase mixture of refrigerant liquid and gas is constantly formed in upper region 102 of the interior of motor housing section 12 adjacent opening 104. In this respect, motor housing section 12 of compressor assembly 10 functions as an economizer within refrigeration system 5. That is, refrigerant flash gas at intermediate pressure is produced while the refrigerant which remains in the liquid state is cooled by virtue of the energy expended in the phase change undergone by the refrigerant which has flashed into gas. As a result, refrigerant gas is made available to the compressor at a pressure higher than compressor suction pressure while liquid refrigerant provided to the evaporator for cooling purposes is supplied at a temperature lower than would otherwise be found absent the economizer feature. The refrigeration system thus described provides the efficiency advantages of economizer coupling without the necessity of providing for a dedicated economizer vessel.

A majority of the refrigerant which remains in the liquid state as it enters motor housing section 12 falls by force of gravity into longitudinally running opening 106 at the top of motor stator jacket 108. Stator jacket opening 106 is positioned beneath opening 104 in motor housing section 12. Although some of the refrigerant which remains a liquid upon entry into motor housing section 12 will be sprayed throughout the interior of the motor housing section by the violence of the flashing action occurring in the upper region 102, most of the refrigerant which remains a liquid within motor housing section 12 falls into stator jacket opening 106. Some of the liquid refrigerant which is sprayed throughout the interior of the motor section and which does not fall into stator jacket opening 106 impacts barrier plate 110 within motor housing section 12. A second amount of the sprayed liquid refrigerant impacts curved interior wall 112 of motor housing section 12 and a third quantity of sprayed liquid refrigerant is directed into the area above upper drain passages 114 of motor mounting portion 116 of compressor section 14. Liquid refrigerant impacting barrier plate 110 and interior wall 112 of motor housing section 12 drains by force of gravity to the bottom of the motor housing section. The liquid refrigerant sprayed into the area above upper drain passages 114 settles downwardly and flows through upper drain passags 114. After passing through upper drain passages 114, such liquid refrigerant cascades into contact with end portion 118 of motor stator 120.

Motor stator 120 is partially disposed within stator jacket 108. Stator jacket 108, which includes first end cover 122 and second end cover 124, defines cooling cavity 126 around motor stator 120. End covers 122 and 124, are sealingly disposed around the periphery of motor stator 120. End cover 124 may be dispensed with in the event that stator jacket 108 is configured to mount directly to motor mounting portion 116 of compressor section 14. Rotor-stator gap 128 which is defined between rotor 130 and stator 120 opens into and is in flow communication with the interior of motor housing section 12 at both ends of rotor 130. Stator 120 defines a series of passages 132 by which flow communication is established between cooling cavity 126 located exterior of stator 120 and rotor-stator gap 128 located interior of stator 120.

Liquid refrigerant falling into opening 106 in the upper portion of stator jacket 108 enters cooling cavity 126 and flows to the bottom thereof. As cooling cavity 126 fills with liquid refrigerant a portion of this refrigerant passes through stator passages 132 and enters rotor-stator gap 128. In normal operation the quantity of liquid refrigerant entering opening 106 of stator jacket 108 more than makes up for the quantity of liquid flowing out of cooling cavity 126 through stator passages 132 and rotor-stator gap 128 into the interior of motor housing section 12. As a result, in operation liquid refrigerant will continuously be found to overflow stator jacket 108 despite the constant flow of liquid refrigerant out of cooling cavity 126 and despite the fact that a portion of the liquid refrigerant entering cooling cavity 126 vaporizes in the process of cooling rotor 130 and stator 120. Rotor 130 and stator 120 are thus continuously bathed and cooled by liquid refrigerant within motor housing section 12. Other rotor-stator configurations in which liquid refrigerant can be brought into intimate heat exchange with the rotor-stator surfaces will be obvious to those skilled in the art. The motor jacketing and stator passage arrangement illustrated, while preferred, is meant to be enabling and not limiting in any sense.

Liquid refrigerant flowing through rotor-stator gap 128 preferablly flows over both end portion 118 and end portion 134 of motor stator 120. Sprayed liquid refrigerant flowing through upper drain passages 114 falls into contact with end portion 118 of stator 120 and mixes there with the liquid refrigerant issuing from rotor-stator gap 128 adjacent end portion 118. The co-mingled liquid refrigerant drains around and over end portion 118 of stator 120 and through lower drain passages 136 of motor mounting portion 116 of compressor section 14. Liquid refrigerant finding its way to the bottom of motor housing section 12 drains out of the motor housing section into conduit section 32 prior to being delivered to expansion device 34.

Economizer coupling is accomplished within compressor assembly 10 by the provision of a flow path between the interior of motor housing section 12 and compression chamber 138 of compressor section 14 within the compressor assembly. In the preferred embodiment, flow passage 140 is defined by conduit section 142 and is in flow communication with passage 144 defined by compressor section 14. Passage 144 terminates and opens into compression chamber 138 of compressor section 14 at open economizer port 146. Open inlet end 148 of conduit section 142 penetrates barrier plate 110 and opens into an area within the interior of motor housing section 12 shielded from the direct effects of liquid refrigerant flashing into gas adjacent opening 104 in upper region 102 of motor housing section 12. Flash gas produced adjacent opening 104 is driven by a pressure differential, as such a pressure differential arises as a consequence of the operation of the refrigeration system, from a location in upper region 102 of motor housing section 12 adjacent opening 104, around lower lip 150 of barrier plate 110 and into the area within motor housing section 12 adjacent open inlet end 148 of conduit section 142. The purpose of barrier plate 110 is to isolate and shield inlet end 148 of conduit section 142 from the liquid filled spray produced as liquid refrigerant flashes into gas adjacent opening 104.

Preferably, only refrigerant gas with little or no entrained liquid refrigerant passes under barrier plate 110, into the vicinity of open inlet end 148 of conduit section 142 and thence into compressor chamber 138. The presence of refrigerant in the liquid state in refrigerant directed from an economizer vessel into the compression chamber of an associated compressor is desired in screw compressor installations where compressor rotor cooling is accomplished at least in part by flashing liquid refrigerant into gas within the compression chamber of the compressor assembly. However, in the preferred embodiment of the present invention as little liquid refrigerant as possible is admitted to open inlet end 148 of conduit section 142 so as to maximize the capacity and efficiency of refrigeration system 5. It is known in the art that the use of liquid refrigerant bled into the compression chamber of a screw compressor to cool the rotors thereon by expansion of the refrigerant liquid into a gas somewhat penalizes overall system performance and is detrimental from the standpoint of maximizing the efficiency and capacity of a refrigeration system. The cooling of compressor rotor 152 and the rotor with which it mates within compression chamber 138 is separately accomplished in the present invention as by the injection of oil into compression chamber 138, a method well known in screw compressor arts and essentially unrelated to the objects of the present invention. Where oil injection is relied upon to cool, seal and/or lubricate the compressor rotors, the entrainment of liquid refrigerant within the injected oil is detrimental from the standpoint of oil separation and the necessity to cool the oil to lower its viscosity for lubrication purposes prior to its injection into the compression chamber of the compressor assembly. For these reasons it is preferred that only refrigerant gas be communicated from motor section 12 into compression chamber 138 in the present invention.

Thus, refrigerant gas produced by the flashing of liquid refrigerant adjacent opening 104 in motor housing section 12 together with gas generated by the contact of liquid refrigerator with motor rotor 130 and motor stator 120 is directed under lower lip 150 of barrier plate 110, into and through open inlet end 148 of conduit section 142 and flow passages 140 and 144, out of economizer port 146 and into compression chamber 138 by the pressure differential which exists in normal operation, between the area adjacent opening 104 in motor housing section 12 and the location at which economizer port 146 opens into compression chamber 138. The location of economizer port 146 within compression chamber 138 and the pressure differential between the area adjacent opening 104 in motor housing section 12 and economizer port 146 will vary from one installation to the next as a function of system operating parameters. In any event, under normal operating conditions the pressure adjacent opening 104 within motor housing section 12 will be greater than the pressure normally found at the economizer port location within the compression chamber 138 and refrigerant gas will migrate from adjacent opening 104 into compression chamber 138. Barrier plate 110 facilitates the delivery of essentially liquid-free refrigerant gas to compression chamber 138 both by shielding open inlet end 148 of conduit section 142 from the liquid filled spray generated adjacent to opening 104 and by constraining refrigerant gas passing from the area adjacent opening 104 to the area adjacent inlet end 148 of conduit section 142 into a series of directional changes. Such directional changes result in the disentrainment of entrained liquid refrigerant droplets from refrigerant gas particularly as the gas passes under lower lip 150 of barrier plate 110.

The level of liquid refrigerant at the bottom of motor section 12 is, again, a function of the operating parameters of each particular refrigeration system. In no case, however, is liquid permitted to accumulate to a level which would interfere with the passage of refrigerant gas under lower lip 150 of barrier plate 110. By virtue of the motor cooling accomplished by jacketing motor stator 120 and by providing for passages by which liquid refrigerant comes into contact with the motor rotor 130, no liquid refrigerant need be maintained within the lower portion of motor housing section 12. Sump 154 may optionally be provided in motor housing section 12 to insure that the level of liquid refrigerant within the motor housing section does not interfere with the delivery of essentially liquid-free refrigerant gas from motor housing section 12 to compression chamber 138. The capacity of sump 154 will preferably be such that any liquid refrigerant accumulating in motor housing section 12 will do so in sump 154. Liquid refrigerant exits the lower portion of motor housing section 12 through lower opening 156.

Compressor motor 158, as should be obvious to those skilled in the art, is comprised of motor rotor 130, motor stator 120, drive shaft 160 and power cables which penetrate motor housing section 12 and are connected to motor stator 120. The power cables are not llustrated in the Figures. Drive shaft 160 supports both motor rotor 130 and compressor rotor 152 and is itself supported by bearings 162 and 164 such that as power is supplied to motor stator 120, motor rotor 130 rotates thereby causing drive shaft 160 and compressor rotor 152 to turn. The rotation of compressor rotor 152 drives a complementary rotor, not shown, with the result that refrigerant gas is compressed between the driving and driven compressor rotors. As previously mentioned, compressor section 14 includes a motor mounting portion 116. Motor stator 120 is supported by motor stator jacket 108 which is in turn supported by motor mounting portion 116. Motor housing section 12 and compressor section 14 are each flanged in a typical manner as is illustrated. These sections may be welded or bolted together to form a hermetically or semi-hermetically sealed screw compressor assembly. Bearings 162 may be sealed bearings which act to seal the interior of motor housing section 12 from compression chamber 138 in compressor section 14 or additional seals may be employed to maintain the two areas sealed from one another in the proximity of drive shaft 160. While the invention has been described with respect to a preferred embodiment, that is, in the context of a refrigeration system employing a screw compressor, it is to be understood that the scope of the invention should be limited only in accordance with the claims which follow.

We claim:

1. A screw compressor assembly internal of which the production of flash gas for economizer coupling a refrigeration system is integrally accomplished in conjunction with the cooling of the compressor drive motor by liquid refrigerant subcooled within the assembly, for a refrigeration system having an expansion device to which the liquid refrigerant output of a condenser is directed, comprising:

a motor housing section having an opening, said opening being in the upper portion of said motor housing section and in flow communication with said expansion device;

a compressor section defining a compression chamber and an economizer port opening into said compression chamber at a predetermined location;

a first screw rotor mounted for rotation in said compression chamber;

a second screw rotor mounted for rotation in said compression chamber, said second screw rotor being meshingly engaged with said first screw rotor;

an electric motor having a rotor and a stator penetrated by at least one passage, said motor disposed within said motor housing section and said rotor and said stator cooperating to define a gap in flow communication with the interior of said motor housing section;

means, drivingly connected to one of said first and second screw rotors, for rotatably supporting said motor rotor so that energization of said motor causes the rotation of said motor rotor, said motor rotor support means and the one of said first and second screw rotors to which said rotor support means is drivingly connected;

passage forming means opening into the interior of said motor housing section, for providing a flow path between the interior of said motor housing and said economizer port opening into said compression chamber in said compressor section; and jacketing means defining an opening, said jacketing means for at least partially enclosing said motor stator and cooperating therewith to define a cavity in flow communication with said rotor-stator gap through said at least one passage penetrating said stator, said opening defined by said jacketing means being positioned vertically below said opening in the upper portion of said motor housing.

2. The screw compressor assembly according to claim 1 further comprising means for shielding the opening of said passage forming means which opens into the interior of said motor housing section from the area adjacent said opening in the upper portion of said motor housing section and for promoting the disentrainment of entrained liquid refrigerant from refrigerant gas passing between said opening in the upper portion of said motor housing section and the opening of said passage forming means which opens into the interior of said motor housing section.

3. The screw compressor assembly according to claim 2 wherein said means for shielding comprises barrier plate disposed in the interior of said motor housing section to divide the interior of said motor housing section into an area inclusive to said area adjacent said opening in the upper portion of said motor housing section and an area shielded from said opening in the upper portion of said motor housing section, said inclusive area and said shielded area being in flow communication and the opening of said passage forming means which opens into the interior of said motor housing section opening into said shielded area.

4. The screw compressor assembly according to claim 3 wherein said passage forming means includes a conduit section extending into the interior of said motor housing section, said conduit section having an open end opening into said shielded area in said motor housing section.

5. The screw compressor assembly according to claim 4 wherein said conduit means penetrates said barrier plate.

6. The screw compressor assembly according to claim 2 wherein said motor housing section defines a second opening, said second opening being defined at the lowest point of said motor housing so that liquid settling in said housing section drains to and through said second opening.

7. The screw compressor assembly according to claim 6 wherein the lower portion of said motor housing section includes a sump area and wherein said second opening defined by said motor housing section is defined in said sump area.

8. The screw compressor assembly according to claim 6 wherein said compressor section includes a motor mounting portion, said electric motor being attached to and supported by said motor mounting portion, said motor mounting portion defining a plurality of drain passages at least one of which is defined in the upper portion of said motor mounting portion so that liquid refrigerant entering said at least one drain passage in the upper portion of said motor mounting portion is directed through said at least one passage and into contact with said electric motor.

9. An economizer coupled refrigeration system lacking a dedicated economizer vessel and in which liquid refrigerant is employed as a motor coolant, comprising:

compressor means, having a suction port and a discharge port and defining a compression chamber into which an economizer port opens, for increasing the pressure of refrigerant gas from a suction to a discharge pressure;

means for condensing refrigerant gas discharged from said discharge port of said compressor means;

an expansion device connected to said condensing means and receiving the entire refrigerant output thereof;

housing means, connecting to said expansion device and in flow communication with said compression chamber in said compressor means through said economizer port, for internally producing, in cooperation with said expansion device, a two-phase mixture of liquid refrigerant flash gas at a pressure intermediate the suction and discharge pressures of said compressor means;

means, connected to said housing means and to said suction port of said compressor means, for vaporizing liquid refrigerant received from said housing means and for delivering vaporized refrigerant to said suction port of said compressor means;

an electric motor having a rotor concentrically mounted within an externally jacketed stator and cooperating therewith to define a rotor-stator gap which opens into the interior of said housing means and is in flow communication with the jacketed portion of the stator, said motor being disposed in said housing means so that at least a portion of the liquid refrigerant portion of said two-phase mixture produced in said housing means is directed into the jacket of said stator, whereby said motor is cooled by continuously replenished liquid refrigerant and, refrigerant flash gas at a pressure intermediate the suction and discharge pressures of said compressor means is delivered from said housing means to said compression chamber in said compressor means through said economizer port.

10. The refrigeration system according to claim 9 further comprising means for disentraining liquid refrigerant from refrigerant flash gas in said housing means.

11. Motor-cooling economizer apparatus, for a refrigeration system which includes an evaporator, a refrigerant compressor section defining a compression chamber into which an economizer port opens, a condenser, an expansion device, all serially connected respectively, and, an electric motor drivingly connected to the compressor section and having a rotor and a stator, the stator being penetrated by a passage and cooperating with the rotor to define a gap therebetween open at at least one end of the motor and in flow communication with the passage penetrating the stator, the motor cooling-economizer apparatus comprising:

motor housing means in flow communication with said compression chamber in said compressor section through said economizer port and sealingly disposed around said motor, said motor housing means being serially connected for flow between said expansion device and said evaporator to close said refrigeration system and said motor housing means defining an opening through which refrigerant is received from said expansion device, said motor housing means for producing, in cooperation with said expansion device, a two-phase mixture of liquid refrigerant and refrigerant flash gas in the area adjacent said opening through which refrigerant is received in said motor housing means from said expansion device, said flash gas being produced at a pressure intermediate the pressure at which refrigerant gas flows into said compressor section from said evaporator and the pressure at which refrigerant gas is discharged from said compressor section to said condenser; and jacketing means defining an opening and at least partially enclosing said motor stator so that said stator and said jacketing means cooperate to define a cooling cavity in flow communication with said passage penetrating said stator, said opening in said jacketing means disposed with respect to said opening in said motor housing means to receive at least a portion of the subcooled liquid refrigerant produced adjacent said opening in said motor housing means, whereby subcooled liquid refrigerant fills said cooling cavity, flows through said passage penetrating said stator, into said rotor-stator gap and out of said rotor-stator gap into said motor housing means to cool said motor while refrigerant flash gas produced in said motor housing means simultaneously passes out of said motor housing means and into said compression chamber of said compressor section through said economizer port to increase the efficiency of said refrigeration system.

12. The motor cooling-economizer apparatus according to claim 11 further comprising barrier plate means disposed in the interior of said motor housing means to divide the interior of said motor housing means into an area exposed to said opening through which refrigerant is received in said motor housing means and an area shielded from said opening through which refrigerant is received, said area adjacent said opening through which refrigerant is received being in flow communication with said shielded area, flow communication between said motor housing means and said compression chamber being effected between said shielded area of said motor housing means and said economizer port opening into said compression chamber in said compressor section and wherein said barrier plate means is disposed in said motor housing means to promote the disentrainment of entrained liquid refrigerant from refrigerant gas passing from said area adjacent said opening to said shielded area.

13. The motor cooling-economizer apparatus according to claim 12 wherein said motor housing means defines a second opening, said second opening being defined in said motor housing means so that liquid refrigerant settling to the bottom of said motor housing means drains to and through said second opening.

14. The motor cooling-economizer apparatus according to claim 13 wherein said motor housing means includes a sump area and said second opening defined by said motor housing means is defined in said sump area, said sump area having a predetermined capacity so that liquid refrigerant accumulating in said motor housing means accumulates only in said sump area prior to draining through said second opening.

15. In a refrigeration system having components which include an evaporator, a compressor section defining a compression chamber into which an economizer port opens, a condenser, an expansion device and a motor housing in which is disposed an electric motor drivingly connected to the compressor section and having a rotor concentrically mounted within an externally jacketed stator and spaced apart therefrom by a rotor-stator gap, all of the system components being serially connected for flow to close the system, and, wherein the motor housing is in flow communication with compression chamber in the compressor section through the economizer port opening thereinto, a method of economizer coupling the refrigeration system while simultaneously cooling the compressor section drive motor comprising the steps of:

passing the entire liquid refrigerant output of the condenser into the expansion device;

passing the liquid refrigerant thus received in the expansion device through the expansion device and directly into the motor housing to produce a two-phase mixture of subcooled liquid refrigerant and refrigerant flash gas at a pressure intermediate the suction and discharge pressures of the compressor section;

directing at least a portion of the subcooled liquid refrigerant portion of the two-phase mixture thus produced into the stator jacket;

bathing the jacketed exterior of the motor stator in liquid refrigerant thus directed into the stator jacket;

passing liquid refrigerant out of the stator jacket and into the rotor-stator gap and thereby into intimate heat exchange relationship with the interior surface of the stator and the exterior of said rotor;

flowing liquid refrigerant thus passed into the rotor-stator gap out of the rotor-stator gap into the interior of the motor housing with the result that liquid refrigerant continuously flows through the stator jacket, into the rotor-stator gap and out of the rotor-stator gap into the motor housing;

passing the flash gas portion of the two-phase mixture in the motor housing into the compression chamber of the compressor section through the economizer port opening thereinto; and passing the liquid refrigerant which passes out of the rotor-stator gap into the motor housing, together with liquid refrigerant not immediately directed into the stator jacket within the motor housing and any liquid refrigerant which overflows the stator jacket, out of the motor housing to the evaporator.

16. The method according to claim 15 further comprising the step of disentraining liquid refrigerant entrained in the flash gas portion of the two-phase mixture prior to the step passing the flash gas into the compression chamber of the compression section.

17. The method according to claim 16 further comprising the step of gathering the liquid refrigerant which has passed out of the rotor-stator gap and into the motor housing, together with liquid refrigerant not immediately directed into the stator jacket within the motor housing and any liquid refrigerant which overflows the stator jacket, in a sump area in the motor housing prior to passing such liquid out of the motor housing to minimize the entrainment of such liquid within the flash gas portion of the two-phase mixture in the motor housing.

18. The method according to claim 16 wherein the directing step includes the directing of liquid refrigerant through the stator, into the rotor-stator gap and out of the rotor-stator gap at both ends of the motor.

19. The method according to claim 16 further comprising the step of directing a portion of the liquid refrigerant in the motor housing not immediately directed into the stator jacket in the motor housing into contact with the unjacketed portion of the stator in the motor housing prior to the step in which such liquid is passed out of the motor housing to the evaporator.

* * * * *

UNITED STATES PATENT AND TRADEMARK OFFICE

CERTIFICATE OF CORRECTION

PATENT NO. : 4,573,324

DATED : March 4, 1986

INVENTOR(S) : James C. Tischer and James W. Larson

It is certified that error appears in the above-identified patent and that said Letters Patent is hereby corrected as shown below:

In The Specification:

Column 7, line 21, "refrigerator" should read --refrigerant--

In The Claims:

Claim 9, Column 10, line 16, "connecting" should read --connected--

Claim 9, Column 10, line 21, after "refrigerant" insert --and refrigerant--

Signed and Sealed this

*Seventeenth* Day of *June 1986*

[SEAL]

*Attest:*

DONALD J. QUIGG

*Attesting Officer*

*Commissioner of Patents and Trademarks*